US007621830B1

(12) United States Patent
Kucek

(10) Patent No.: US 7,621,830 B1
(45) **Date of Patent: *Nov. 24, 2009**

(54) SOFTBALL PITCHING TRAINING DEVICE

(75) Inventor: Jack Kucek, Canfield, OH (US)

(73) Assignee: Strikeout Strippz LLC, Columbiana, OH (US)

( * ) Notice: Subject to any disclaimer, the term of this patent is extended or adjusted under 35 U.S.C. 154(b) by 10 days.

This patent is subject to a terminal disclaimer.

(21) Appl. No.: 11/811,656

(22) Filed: Jun. 12, 2007

Related U.S. Application Data

(63) Continuation of application No. 11/166,814, filed on Jun. 27, 2005, now Pat. No. 7,244,197.

(51) Int. Cl.
*A63B 69/00* (2006.01)
*A41D 19/00* (2006.01)

(52) U.S. Cl. ..... 473/458; 473/464; 473/422; 473/450; 2/161.1; 2/19

(58) Field of Classification Search ..... 473/422, 473/450, 458, 464, 59, 205; 2/159, 160, 2/161.1, 161.2, 161.3, 161.6, 163; 294/25; 601/40

See application file for complete search history.

(56) References Cited

U.S. PATENT DOCUMENTS 883,761 A * 4/1908 Taylor ..... 294/25
3,408,657 A * 11/1968 Gallagher ..... 2/159
3,997,159 A 12/1976 Malhas
4,253,664 A 3/1981 Daulton
4,698,850 A * 10/1987 Patton et al. ..... 2/159
4,753,442 A 6/1988 Bland
4,796,306 A * 1/1989 Mitchell ..... 473/205
5,224,220 A * 7/1993 Andriola ..... 2/160
5,435,013 A * 7/1995 Davis ..... 2/161.1
5,876,292 A 3/1999 Hamilton
6,447,464 B1 * 9/2002 Dunlevy et al. ..... 601/40
6,553,576 B1 * 4/2003 Knapp ..... 2/161.6
7,415,735 B2 * 8/2008 Erickson et al. ..... 2/163
2003/0211905 A1 11/2003 Miller

* cited by examiner

*Primary Examiner*—Mitra Aryanpour
(74) *Attorney, Agent, or Firm*—Harpman & Harpman

(57) ABSTRACT

A device and method of use in learning, practicing and perfecting softball pitching motions comprising, a practice glove worn on the pitching hand having multiple finger portions each with an extending indicator element removably positioned thereon. The indicator elements extending as independent elongated flexible bands removably secured and attached on the ends of index finger portion tabs of the adjacent finger portion. By practicing the pitching motion, the relative position of the indicator bands will confirm and teach proper pitching arm and hand position through the multiple underhand pitching sequence of softball pitching action.

2 Claims, 5 Drawing Sheets

SOFTBALL PITCHING TRAINING DEVICE

This is a continuation in part of application of Ser. No. 11/166,814, filed Jun. 27, 2005 now U.S. Pat. No. 7,244,197.

BACKGROUND OF THE INVENTION

1. Technical Field

This device and method relates to the teaching of proper softball pitching techniques to improve the pitching mechanics of the pitcher.

2. Description of Prior Art

Prior art devices of this type are unknown for softball pitching. A variety of sports related devices have been developed to teach proper sports form and mechanics, see for example U.S. Pat. No. 3,997,159 on a tennis training device that has a weighted flexible tether that is grasped at one end and swung forward using the motion associated with the exaggerated throwing of a baseball to teach the proper arm stroke used in tennis.

U.S. Pat. No. 4,253,664 discloses another tennis training device that uses a pair of weighted elongated pouches attached to a handle at one end.

A baseball glove with an automatic ball return device is claimed in U.S. Pat. No. 4,753,442 that is used with a baseball glove and has a baseball attached to the end of a flexible line. The other end of the line extends from a retractable spool positioned on the backside of a baseball glove.

In U.S. Pat. No. 5,876,292 a golf training aid is disclosed using a clicker which is slidably positioned on an extension element from the golfer's wrist.

Finally, in U.S. Patent Publication US 2003/0210905 A1 a dual purpose child's baseball glove is disclosed having a baseball secured to the end of the resilient tether extending from the ball and attached on the other end to the glove.

SUMMARY OF THE INVENTION

A softball method and teaching device for pitching in which a specialized sports glove is used by the pitcher to simulate the action of underhand pitching of a softball. The glove has positioning indicator strips removably positioned on the ends of its multiple finger portions to provide for a visual indicator of the pitching arm and hand position during the act of pitching. By following a set of method steps the correct arm and hand action position can be taught and confirmed by the resulting positioning of the indicator strips in relation to the pitcher's body.

DETAILED DESCRIPTION OF THE INVENTION

Figure 1:
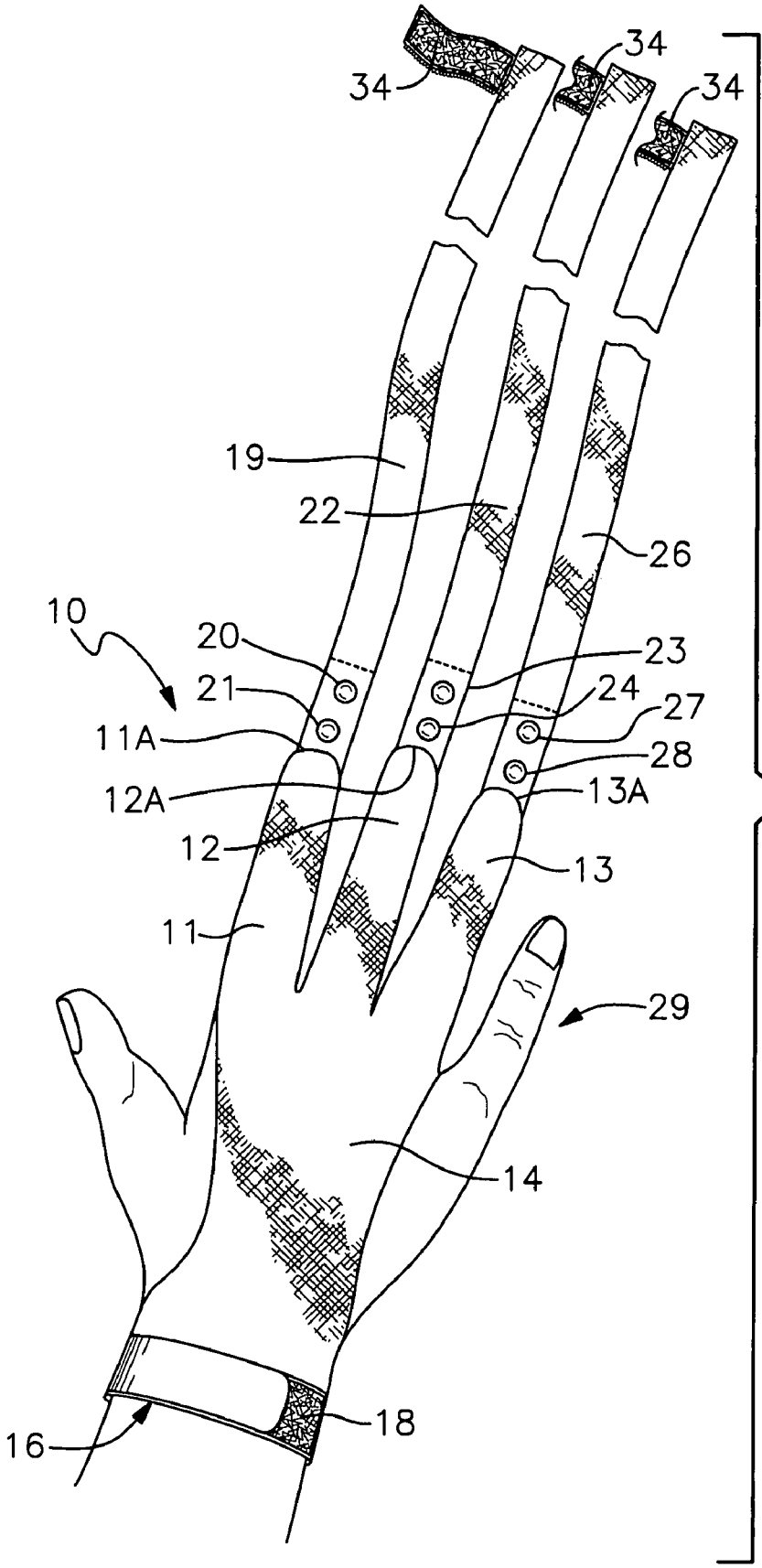
FIG. 1 is an enlarged perspective view of the back side of the training glove of the invention on a hand of a pitcher.
Figure 2:
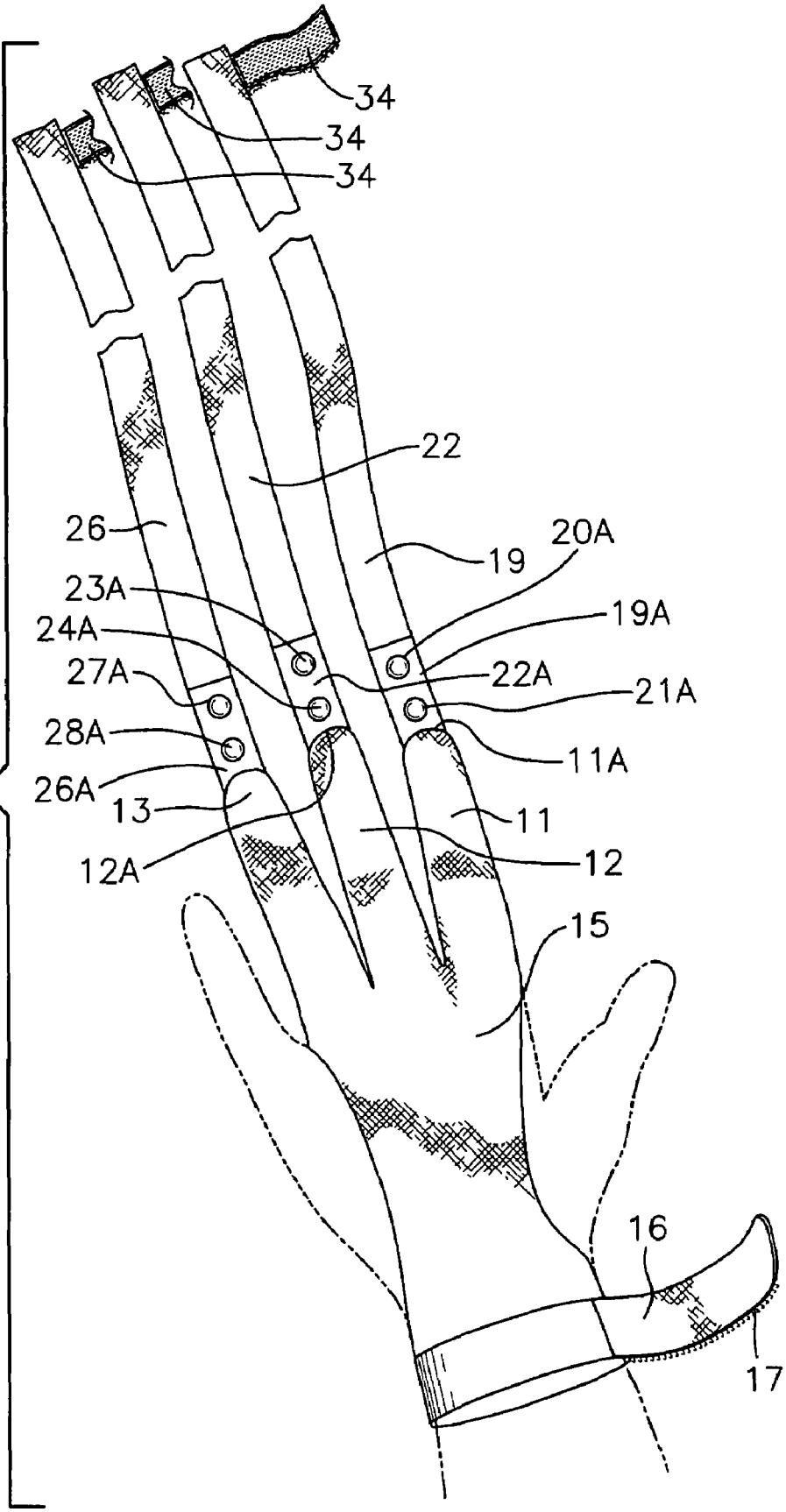
FIG. 2 is an enlarged perspective view of the palm side of the training glove.
Figure 3:
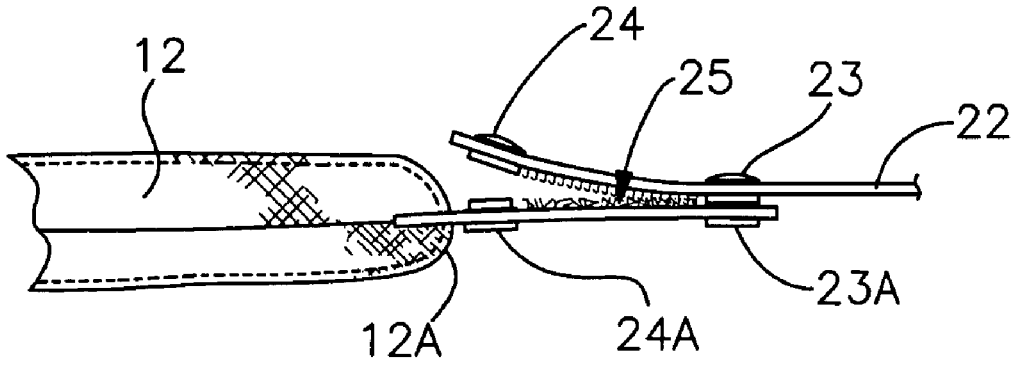
FIG. 3 is an enlarged side elevational view of the of the attachment tabs.

Referring now to FIGS. 1, 2, and 3 of the drawings, a training glove 10 of the invention for teaching softball pitching can be seen. The glove 10 has three finger portions 11, 12, and 13 and a backhand portion 14. A palm portion 15 which interconnects the hereinbefore described finger portions with an integral removable secured wrist engagement band 16 extending in overlapping relationship having co-dependent inter-engaging hooked loop fasteners 17 and 18 respectively thereon to form an adjustable closure thereabout.

The finger portion 11 defined as the "index finger" has a position indicator band 19 of the invention removably secured on a finger extension tab 19A extending from an end tip portion 11A. The indicator band 19 is of an elongated flat flexible synthetic fabric material of extended length as will be described in greater detail hereinafter. The indicator band 19 is of a transverse dimension equal to that of the finger portion 11 from which it extends and is flexible, as noted, due to its extended length and the properties of the material from which it is made. The indicator band 19 has attachment fastener elements 20 and 21 thereon for selective registration to corresponding fastener elements 20A and 21A attached to the extension tab 19A.

A second indicator band 22 is removably secured on a finger extension tab 22A extending from an end tip 12A of the finger portion 12 adjacent that of the first "index" finger portion 11. The second indicator band 22 is of the same material and dimensional characteristics as of the first indicator band 19 as hereinbefore described with fastener elements 23 and 24 thereon for engagement with corresponding fasteners elements 23A and 24A on its finger extension tab 12 A and are of an interlocking nature such as "snap" fasteners and hook and loop material 25 "Velcro"® as best seen in FIG. 3 of the drawings.

A third indicator band 26 of the invention is removably secured on a finger extension tab 26A extending from an end tip 13A of the finger portion 13 adjacent to the hereinbefore described finger portion 13. The indicator band 26 also has fastener elements 27 and 28 for registering with corresponding fastener elements 27A and 28A of the same configuration as hereinbefore described.

Referring now to FIGS. 4-10 of the drawings, a glove hand 29 and pitching arm 30 positions of the training glove 10's indicator bands 19, 22, and 26 are illustrated for softball pitching motion in which a pitching arm 30 position and action are different for the underhand throwing style of fast pitch softball as will be well understood by those skilled in the art.

Figure 4:
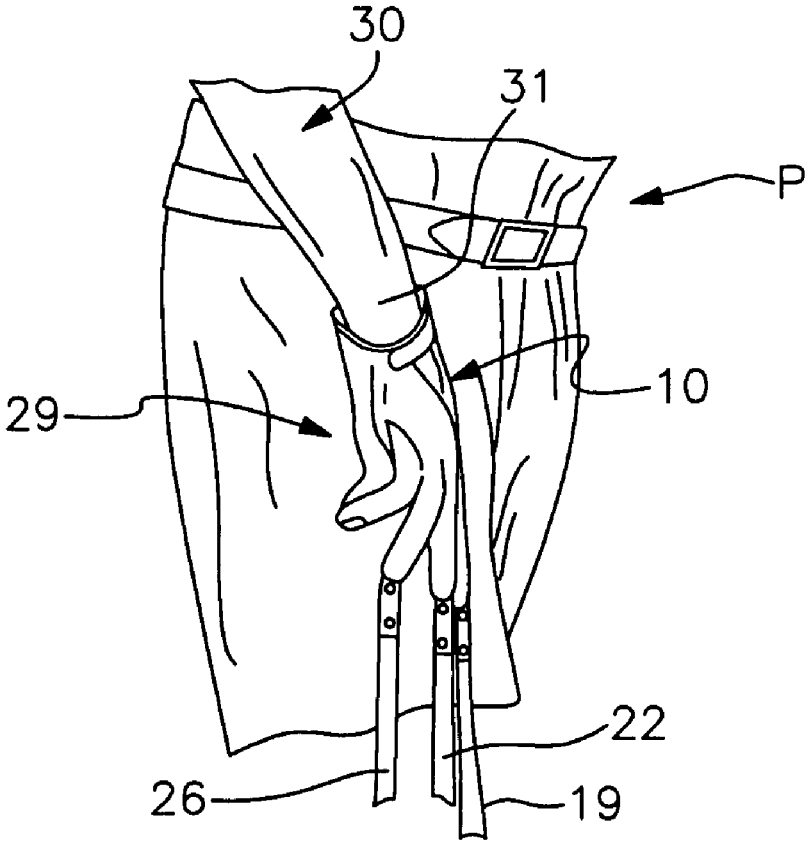
FIG. 4 is a partial perspective view illustrating the first indicator position of the pitcher with the training glove of the invention.

In FIG. 4 of the drawings specifically a hand relaxed position is shown with the pitching arm 30 extending downwardly and accordingly the indicator bands 19, 22, and 26 of the invention hanging straight down from the training glove 10.

Figure 5:
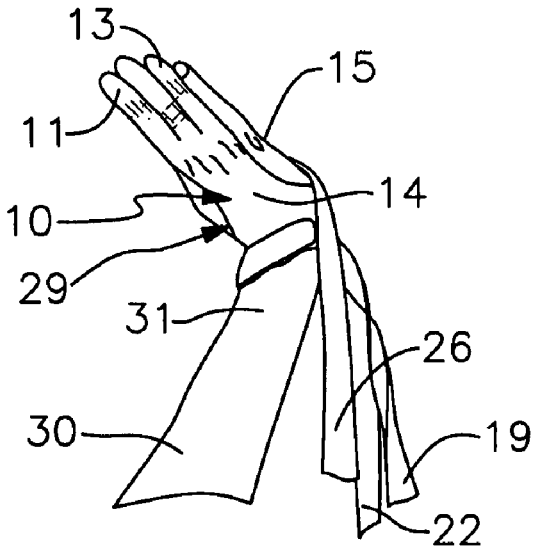
FIG. 5 is a partial perspective view illustrating the second indication position of a pitcher with the training glove.

In FIG. 5 of the drawings, the illustrated portion of the softball pitch mechanics is illustrated as the pitching hand 29 swings forward with the wrist 31 caulked backwards. The indicator bands 19, 22, and 26 will then lie across if properly done the palm portion 15 with the remaining sections of the bands hanging straight down. This "setting" of the wrist is a position in which the hand is snapped forward upon release during the pitching action.

Figure 6:
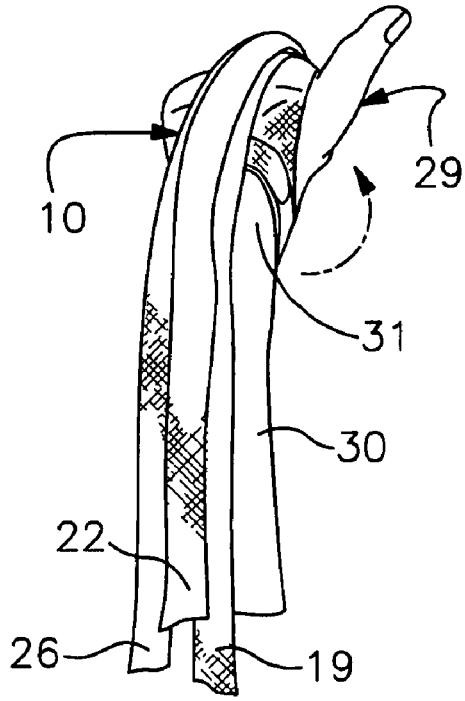
FIG. 6 is a partial perspective view of the third indicator position.

Referring now to FIG. 6 of the drawings, an illustration of the hand 29 rotation towards the third base of a playing field (not shown) for right hand pitchers keeping the wrist 31 caulked back so that the indicator bands 19, 22, and 26 lay across the palm 15 of the hand 29 and hang straight down thus setting the wrist 31 in position to "snap" forward upon release during the pitching action.

Figure 7:
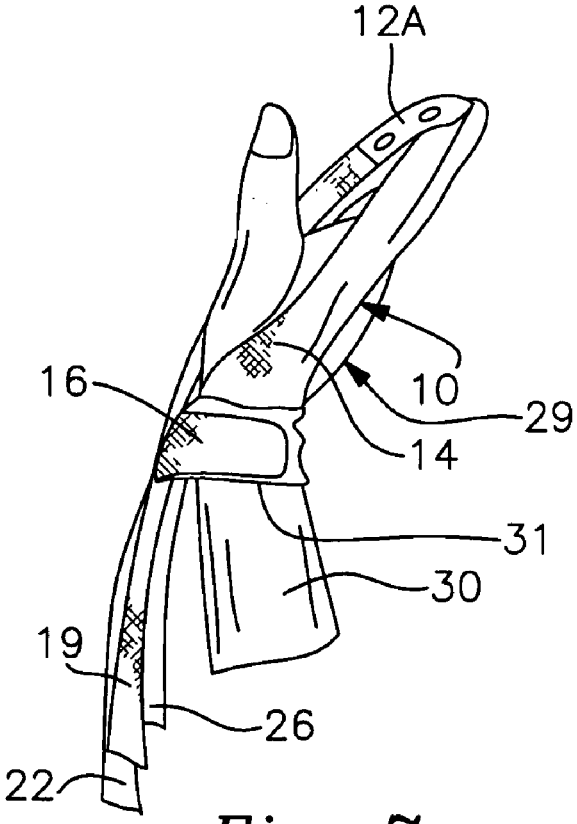
FIG. 7 is a partial perspective view of the fourth indicator position.

Referring now to FIG. 7 of the drawings, the pitcher's hand 29 is shown as rotating back towards the second base of the softball field (not shown) again keeping the wrist 31 caulked back with the indicator bands 19, 22, and 26 laying thereacross and hanging straight down. This keeps the wrist in position to "snap" forward.

Figure 8:
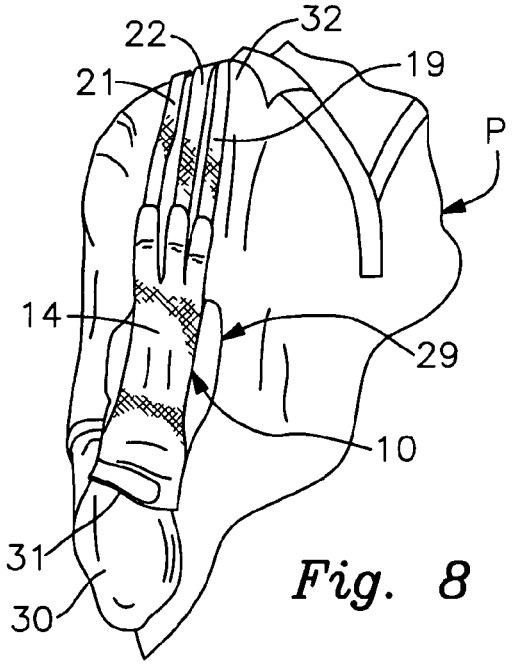
FIG. 8 is a partial perspective view of the fifth indicator position.

For a fastball pitch as seen in FIG. 8 of the drawings illustrating the arm 30 rotating to throw the ball (not shown) with the wrist 31 "snaps" forward with the indicator bands 19, 22, and 26 flying over and landing on the shoulder 32 of the player P ensuring proper fastball technique for softball which will be evident to those skilled in the art.

Figure 9:
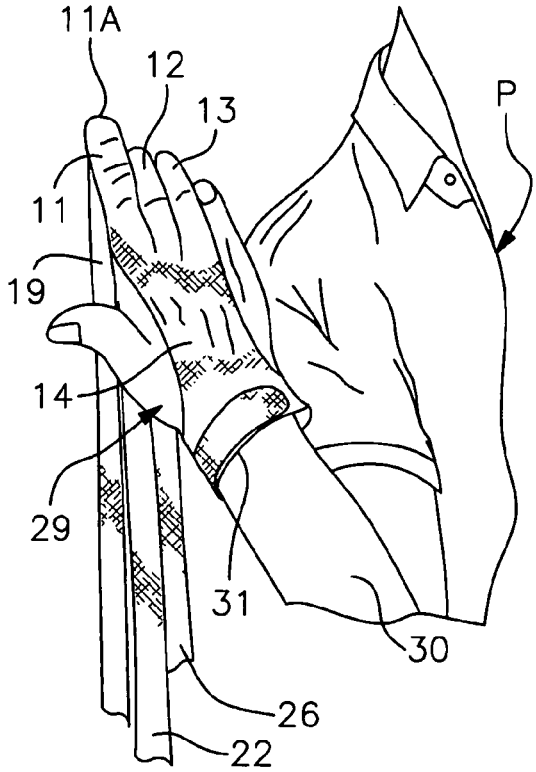
FIG. 9 is a partial perspective view of the sixth indicator position of the invention.

In FIG. 9 of the drawings, the proper position of indicator bands 19, 22, and 26 are shown for throwing a "rise ball". The pitching arm 30 rotates to throw the ball to the plate (not shown) with the wrist 31 now "snaps" forward with the indicator bands 19, 22, and 26 flying away. The indicator bands 19, 22, and 26 must fly forward towards first base or third base of a playing field (not shown) depending on a right hand or a left hand pitcher away from the throwing shoulder. This position of the indicator bands 19, 22, and 26 will indicate a proper "rise ball" technique has been followed.

Figure 10:
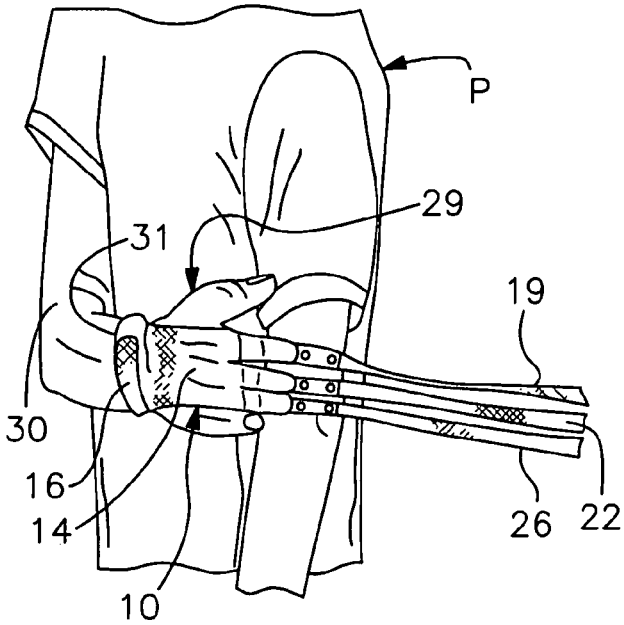
FIG. 10 is a partial perspective view of the final indicator position.

Finally, in FIG. 10 of the drawings, a proper "curve" ball technique is illustrated for underhanded softball pitching so as the pitching arm 30 rotates the wrist 31 which now "snaps" forward with the result that the indicator bands 19, 22, and 26 of the invention fly transversely across the pitcher's body B. Specifically, the indicator bands 19, 22, and 26 must fly towards first base or third base of the field (not shown) as noted above and across the pitcher's stomach 33.

Referring back now to FIGS. 1 and 2 of the drawings, length adjustment tabs 34 can be seen secured to and extending from the respective indicator bands 19, 22, and 26 at right angles thereto. The tabs 34 have opposily disposed hook and loop fastening material so as to be engageable on itself around the respective indicator bands when doubled back on themselves this for shortening the overall length of the respective band when secured by wrapping with the adjustment tabs 34 secured to themselves.

It will be seen from the above description and illustrations that by use of the training glove 10 and the integral indicating bands 19, 22, and 26 of the invention a visual indication system of proper softball pitching techniques has been disclosed. It will thus be seen that a new and novel softball training glove has been illustrated and described and it will be apparent to those skilled in the art that various changes can be made therein without departing from the spirit of the invention.

Therefore I claim:

1. A softball training glove for use in teaching proper pitching techniques comprises, a glove body having multiple finger portions, said finger portions are an index finger portion and adjacent finger portions, an elongated flexible indicator band extending from said respective finger portions, said indicator bands are each of a transverse dimension equal to that of said respective finger portions, interengagement fasteners on said bands and tabs extending from said finger portions, said indicator bands are of a length to hang freely from and beyond said tabs and finger portions in some underhand pitching arm and pitching hand positions when simulating a pitching action, said bands extending beyond said finger portions in relation to a pitcher's body, wherein said elongated flexible indicator bands further comprise length adjustment tabs extending at right angles therefrom in spaced relation to said tabs, wherein when wearing said training glove the position of said bands, the means for retaining said glove on said pitching hand and the means for securing said band elements to said finger portions aid in teaching the proper pitching arm and hand positions through multiple underhand pitching sequence of softball pitching action.

2. The softball training glove set forth in claim 1 wherein said means for retaining said glove on said pitching hand comprises, an adjustable closure flap extending from said glove in space relation to said finger portions.

* * * * *